US006935961B2

(12) United States Patent
Sugawara

(10) Patent No.: US 6,935,961 B2
(45) Date of Patent: Aug. 30, 2005

(54) CONJURING TOOL FOR PERFORMING COIN INCREASING TRICK

(75) Inventor: Shigeru Sugawara, Tokyo (JP)

(73) Assignee: Tenyo Co., Ltd., Tokyo (JP)

( * ) Notice: Subject to any disclaimer, the term of this patent is extended or adjusted under 35 U.S.C. 154(b) by 0 days.

(21) Appl. No.: 10/827,364

(22) Filed: Apr. 20, 2004

(65) Prior Publication Data

US 2005/0014568 A1 Jan. 20, 2005

(30) Foreign Application Priority Data

May 15, 2003 (JP) ..... 2003-137469

(51) Int. Cl.[7] ..... A63J 21/00
(52) U.S. Cl. ..... 472/71; 472/74
(58) Field of Search ..... 472/61, 62, 71–74; 40/427, 445

(56) References Cited

U.S. PATENT DOCUMENTS 460,331 A * 9/1891 Clark ..... 472/71
2,498,298 A * 2/1950 Renz ..... 472/71
3,801,094 A * 4/1974 Treaster ..... 472/72
4,339,120 A * 7/1982 Czarny ..... 472/72
4,557,476 A * 12/1985 Kato ..... 472/71
4,984,782 A * 1/1991 Ruger ..... 472/72
5,348,220 A * 9/1994 Setteducati ..... 232/1 D
5,449,324 A * 9/1995 Sugawara ..... 472/69
5,456,636 A * 10/1995 Suzuki ..... 472/73
5,549,515 A * 8/1996 Kondo ..... 472/71
5,558,583 A * 9/1996 Shimomura ..... 472/71

FOREIGN PATENT DOCUMENTS

DE 3634326 A1 * 4/1988 ..... A63J/21/00
GB 2218968 A * 11/1989 ..... A63J/21/00

* cited by examiner

*Primary Examiner*—Kien Nguyen
(74) *Attorney, Agent, or Firm*—Swidler Berlin LLP

(57) ABSTRACT

With a view to providing a conjuring tool which is simple in construction and operation, an interior of a case main body 2 is divided by a partition plate 5 into two portions such as a coin accommodating portion 6 for accommodating coins 20 in a state in which coins are stacked one on another vertically in advance and a coin introducing portion 7 for introducing coins 20*a* during a play, the partition plate 5 is fixed to an interior surface of a top wall of the case main body 2, and a slit 5*a* is formed between a lower end of the partition plate 5 and a bottom wall of the case main body 2 for allowing coins 20 accommodated within the coin accommodating portion 6 to pass therethrough into the coin introducing portion 7 one by one.

8 Claims, 2 Drawing Sheets

CONJURING TOOL FOR PERFORMING COIN INCREASING TRICK

BACKGROUND OF THE INVENTION

1. Field of the Invention

The present invention relates to a conjuring tool using coins, and more particularly to a conjuring tool for performing a coin increasing trick which can give the audience an illusion that the number of coins accommodated in a box increases successively in the box.

2. Description of Related Art

Conventionally, there are various types of conjuring tools using coins. However, those are conjuring tools for performing a conjuring trick in which, for example, a person for performing conjuring tricks (hereinafter, referred to as an operator) puts some coins in a box, closes a lid of the box once and thereafter opens the lid for the audience to find that the number of coins has changed from the number of coins initially put in the box. As a conjuring tool like this, a conjuring tool is described, for example, in the official gazette of Japanese Patent No. 2565661 which is a document describing related art.

Here, an invention described in the related art document relates to a conjuring tool for performing a coin decreasing trick in which for example, two coins is decreased to one, or a conjuring trick which gives the audience an illusion that the number of coins decreases.

In contrast to this, there has been proposed no conjuring tool for performing a conjuring trick which gives the audience an illusion that the number of coins increases in a box which is simple in construction and operation. In particular, there has never existed a conjuring tool for performing a conjuring trick in which a series of actions of putting some coins in a box, closing a lid of the box once and then opening the lid for the audience to find that the number coins increases successively from the number of coins initially put in the box.

SUMMARY OF THE INVENTION

Then, an object of the invention is to provide a conjuring tool for performing a coin increasing trick in which the number of coins increases successively from the initial number of coins every time a series of actions of accommodating some coins in a box, closing the lid of the box once and then opening the lid is repeated which conjuring tool is simple in construction and operation.

With a view to attaining the object, according to an aspect of the invention, there is provided a conjuring tool for performing a coin increasing trick having a case main body which is formed into a hollow rectangular parallelepiped and a coin receiving opening closing lid for closing a coin receiving opening which is one of openings of the case main body, wherein an interior of the case main body is divided by a partition plate into two portions such as a coin accommodating portion formed between the partition plate and the coin receiving opening for accommodating coins in a state in which coins are stacked one on another vertically in advance and a coin introducing portion formed between the partition plate and a coin introducing opening which is the other opening of the case main body for introducing coins during a play, and wherein the partition plate is fixed to an interior surface of a top wall of the case main body and a slit is formed between a lower end of the partition plate and a bottom wall of the case main body for allowing coins accommodated within the coin accommodating portion to pass therethrough into the coin introducing portion one by one.

DESCRIPTION OF THE PREFERRED EMBODIMENTS

A coin increasing trick performing conjuring tool according to an embodiment of the invention will be described below with reference to the accompanying drawings.

[Construction of Coin Increasing Trick Performing Conjuring Tool]

Firstly, referring to FIGS. 1 and 2, the construction of a coin increasing trick performing conjuring tool 1 according to the invention will be described. The coin increasing trick performing conjuring tool 1 according to the invention includes a hollow case main body 2 which is made to open in both left and right ends thereof, and two lids 3, 4 for closing the openings so formed. Then, the case main body 2 is formed into substantially a rectangular parallelepiped, and a partition plate 5 is provided in the interior of the case main body so as to divide the interior of the case main body longitudinally into two portions.

Figure 1:
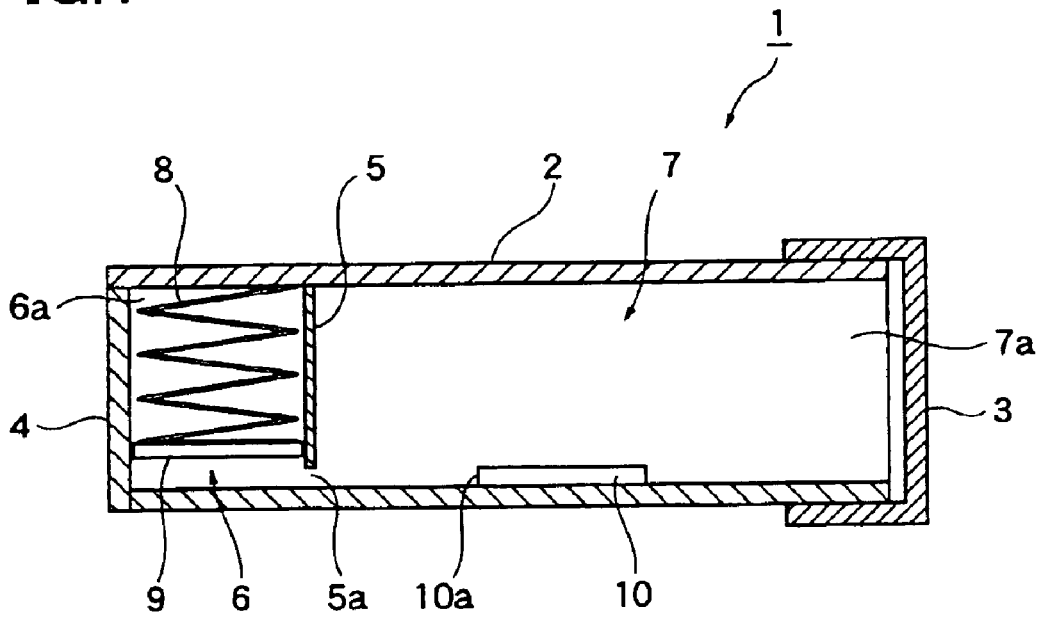
FIG. 1 is a cross-sectional view showing a constituent part of a conjuring tool for performing a coin increasing trick according to one embodiment of the invention.
Figure 2:
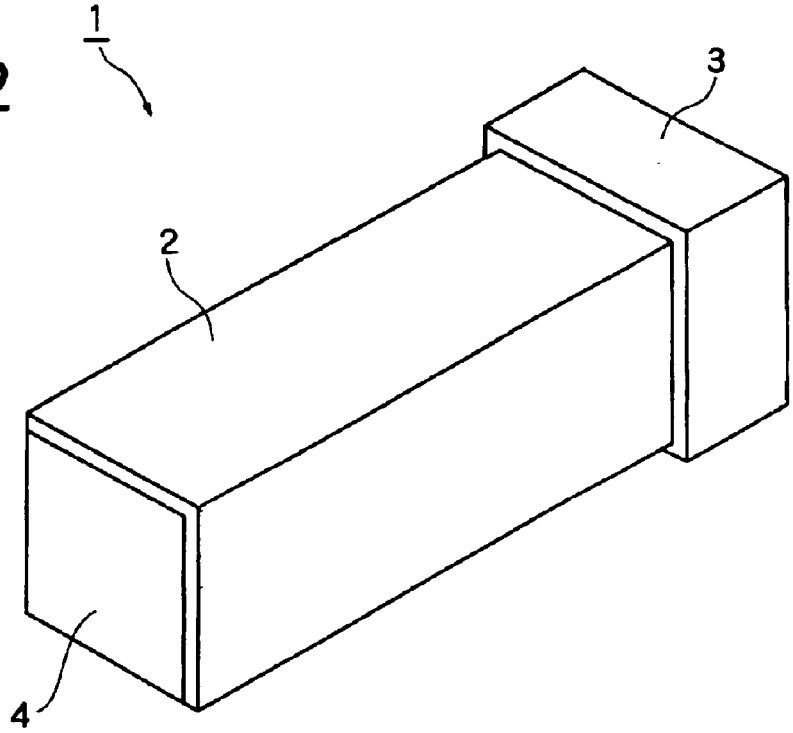
FIG. 2 is a perspective view showing the constituent part of the conjuring tool for performing a coin increasing trick shown in FIG. 1.

As shown in FIG. 1, the partition wall 5 is provided at a position which is located inwardly of the case from one of openings of the case main body 2 by a distance equal to or slightly larger than the diameter of a coin in such a manner as to be parallel with an end of the case main body 2 where the opening is formed. Then, by providing the partition plate 5 like this, the interior of the case main body 2 is divided into two portions; a coin accommodating portion 6 on a side facing one of the openings (hereinafter, referred to as a coin accommodating opening 6*a*) and a coin introducing portion 7 on a side facing the other opening (hereinafter, referred to as a coin introducing opening 7*a*), and coins can be accommodated in the coin accommodating portion 6 in advance in a state in which the coins are stacked in a vertical direction, as will be described later on.

In addition, the partition plate 5 is fixedly provided on an interior surface of a top wall of the case main body 2, and furthermore, a slit 5*a* is formed between a lower end of the partition plate 5 and a bottom wall of the case main body 2 for allowing coins 20 accommodated in the coin accommodating portion 6 to pass therethrough one by one into the coin introducing portion 7. Consequently, a width in a vertical direction of the slit 5*a* may be set to a size slightly larger than the thickness of a thickest coin of the coins 20 or must be of a smaller size which is smaller than the total thickness of two coins at the maximum.

Then, a vertical expandable spring 8 is secured to the top wall of the case main body 2 at one end thereof as shown in FIG. 1, and a presser plate 9 for pressing against a coin 20 accommodated is provided at the other end of the spring 8. By this construction, coins 20 are to be accommodated within a space formed between the presser plate 9 and the bottom wall of the case main body 2.

Furthermore, a coin stopper 10 which forms a difference in level 10*a* for stopping coins 20 which have moved from the coin accommodating portion 6 to the coin introducing portion 7 is provided on the bottom wall of the case main body 2. In addition, a space which is equal to or slightly larger than the diameter of the coin 20 is provided between the difference in level 10*a* and the slit 5*a*.

Note that of the two lids of the embodiment, the shape of the introducing opening closing lid which is the lid 4 for closing the coin accommodating opening 6*a* is formed into a plate-like shape, which is made different from the shape of the lid 3 for closing the coin introducing opening 7*a*, whereby as will be described later on, the operator can discriminate the lid 3 on the side from which coin 20 is introduced into the case main body 2 from the other lid 4. In addition, the plate-like lid 4 is constructed so as to engage with the case main body 2 in the coin accommodating opening 6*a* in order that the plate-like lid 4 is dislocated during an operation.

[Procedure for Operating the Coin Increasing Trick Performing Conjuring Tool]

Next, referring to FIGS. 3 and 4, an example of a procedure for performing a conjuring trick using the coin increasing trick performing conjuring tool that has been constructed as described above will be described.

Figure 3:
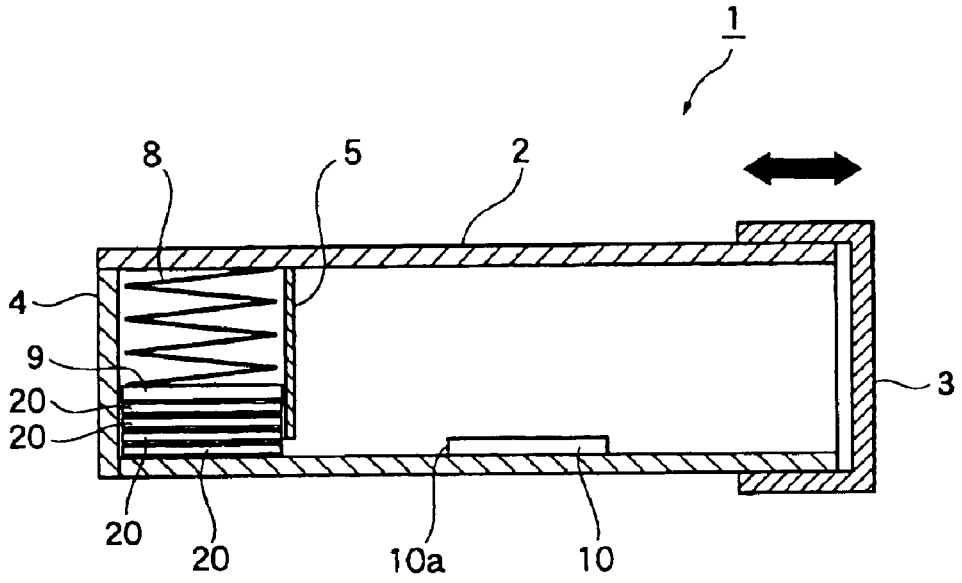
FIG. 3 is a cross-sectional view showing a state in which coins are accommodated in advance in the conjuring tool for performing a coin increasing trick according to the embodiment of the invention.
Figure 4:
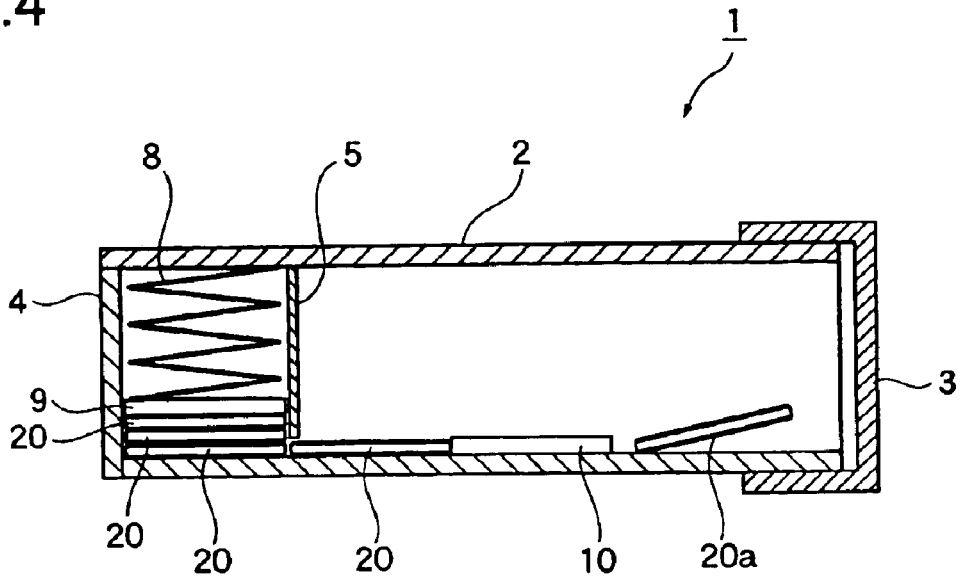
FIG. 4 is a cross-sectional view explaining conditions within the case main body resulting after the case main body is shaken after an operator introduces coins to realize the state shown in FIG. 3.

Firstly, before performing a conjuring trick, the operator opens the accommodating opening closing lid which is the plate-like plate 4, accommodates a plurality of coins 20 of the same type in the coin accommodating portion 6 of the case main body 2 as shown in FIG. 3, and closes the coin accommodating opening 6*a* with the plate-like lid 4. As this occurs, the coins 20 so accommodated are accommodated in a state in which the coins 20 are pressed against the bottom wall of the case main body 2 by the spring 8 via the presser plate 9.

Then, the operator grasps the case main body 2 accommodating therein the coins 20 as has been described above, removes the lid 3 and introduces only a single coin 20*a* of the same type as that of the coins so accommodated into the case main body 2 from the coin introducing opening 7*a*. Then, the lid 3 is closed after the coin has been introduced, grasps the case main body 2 while pressing the lid 3 with the finger and shakes it in a longitudinal direction of the case (in a direction indicated by an arrow). As this occurs, the case main body 2 must be shaken with the bottom wall of the case main body 2 (namely, the side where the slit 5*a* exists) being faced downwards.

When the case main body 2 is shaken like this, one coin 20 of the coins 20 accommodated in the coin accommodating portion 6 that constitutes a lowest-positioned coin moves from the coin accommodating portion 6 to the coin introducing portion 7 while passing through the slid 5*a*. Then, the coin 20 is stopped from moving by the difference in level 10*a* formed by the stopper 10, and a condition shown in FIG. 4 results in the interior of the case main body 2. As this occurs, the coins 20 remaining in the coin accommodating portion 6 are accommodated in such a manner that they are pressed against the bottom wall of the case main body 2 by the spring 8 via the presser plate 9. In addition, since a coin 20 that is being positioned lowest of the coins 20 in the coin accommodating portion 6 is stopped from moving from the slit 5*a* to the coin introducing portion 7 side by the coin 20 that is stopped from moving by the difference in level 10*a*, even if the case main body 2 is shaken by the operator as has been described above, there is no case where an additional coin 20 is caused to move into the coin introducing portion 7 provided that the case main body 20 is shaken considerably violently.

Then, when the operator shakes the case main body 2 vertically after the aforesaid operation so that the coin 20 that has so moved is released from the engagement with the difference in level 10*a* of the stopper 10, thereafter opens the lid 3 and inclines the case main body 2 in such a manner that the coin introducing opening 7*a* is positioned to face downwards, the coin 20 introduced from the coin introducing opening 7*a* and the coin 20 that has moved from the coin accommodating portion 6 to the coin introducing portion 7 come to appear from the case main body 2. Thus, an illusion can be given to the audience that although the single coin 20 was introduced into the case main body 2, another coin 20 was increased within the case main body 2, and there appeared the two coins 20.

In addition, with a number of coins 20 being accommodated in advance in the coin accommodating portion 6, when, following the series of actions, two coins are introduced again from the coin introducing opening 7*a*, the lid 3 is closed and then the series of actions including shaking the case main body 2 in the longitudinal direction is repeated, the two coins are increased to three, which then come out of the case main body 2. Thus, as has been described heretofore, according to the coin increasing trick performing conjuring tool 1, a wonder can be given to the audience that a coin is increased one by one in the case main body 2.

[Second Embodiment]

In addition, while, in the first embodiment, the operation is carried out such that the illusion is given to the audience that coins of the same type are increased one by one, an illusion can be given to the audience that coins of the same type are doubled by shaking hard the case main body 2. For example, after two coins have been introduced, by repeating twice an coin moving operation to move a coin from the coin accommodating portion 6 to the coin introducing portion 7 and an operation to release the engagement of the coin that has so moved with the difference in level 10*a*, when the case main body 2 is inclined with the lid 3 having been removed, four coins appear from the case main body 2, whereby the audience can be given an illusion that two coins were increased to four.

[Third Embodiment]

Additionally, while, in the first and second embodiments, coins of the same type are used, an illusion can also be given to the audience that with coins of different types being accommodated in the coin accommodating portion in a mixed fashion, coins of different types are increased successively.

For example, coins are accommodated in the coin accommodating portion 6 in such a manner that a 5-cent coin, a 10-cent coin and furthermore, a 25-cent coin are stacked in that order from the bottom. Then, the operator introduces a 5-cent coin into the coin introducing portion 7 and performs the series of operations, whereby the single 5-cent coin is increased to two. Following this, in the event that the operator introduces a 10-cent coin into the coin introducing portion 7 and performs similar operations, further introducing a 25-cent coin and performing similar operations, not only the 5-cent coin but also the 25-cent coin are increased successively to two, respectively.

Thus, as has been described above, when coins of different types are accommodated in the mixed fashion, remembering the order in which coins are accommodated, the operator introduces corresponding coins in type in that order, whereby coins in different types are increased successively, thus making it possible to give the audience a new type of illusion.

Note that in the coin increasing trick performing conjuring tool 1, in order to increase the number of coins that are accommodated in advance, the height (the size in the vertical direction) of the case main body may only have to be increased appropriately. In addition, while, in the respective embodiments that have been described heretofore, the operations are carried out with the coin introducing opening being closed with the lid, the operations may be performed by closing the coin introducing opening directly with the finger of the operator without using the lid.

INDUSTRIAL APPLICABILITY

Thus, as has been described heretofore, according to the coin increasing trick performing conjuring tool 1, by repeating the operations of accommodating the coins in the box, placing the lid of the box once, and thereafter opening the lid of the box, the wonder can be given to the audience that the number of coins are increased successively from the number of coins at the time of introduction thereof. Furthermore, with the coin increasing trick performing conjuring tool, since the construction is simple and the operation is also simple, there is provided an advantage where even a child who is unskilled and who has no technique can do conjuring tricks using the coin increasing trick performing conjuring tool.

What is claimed is:

1. A conjuring tool for performing a coin increasing trick having:

a case main body which is formed into a hollow rectangular parallelepiped; and a coin receiving opening closing lid for closing a coin receiving opening which is one of openings of the case main body, wherein:

an interior of the case main body is divided by a partition plate into two portions such as a coin accommodating portion formed between the partition plate and the coin receiving opening for accommodating coins in a state in which coins are stacked one on another vertically in advance and a coin introducing portion formed between the partition plate and a coin introducing opening which is the other opening of the case main body for introducing coins during a play; and wherein the partition plate is fixed to an interior surface of a top wall of the case main body and a slit is formed between a lower end of the partition plate and a bottom wall of the case main body for allowing coins accommodated within the coin accommodating portion to pass therethrough into the coin introducing portion one by one.

2. A conjuring tool for performing a coin increasing trick as set forth in claim 1, wherein a coin stopper constituting a difference in level for stopping a coin that has moved from the coin accommodating portion to the coin introducing portion is formed on a bottom wall of the case main body within the coin accommodating portion in such a manner that an interval from the slit to the difference in level so formed becomes a size in length that is equal to or slightly larger than the diameter of a coin.

3. A conjuring tool for performing a coin increasing trick as set forth in claim 2, wherein a spring which is fixedly attached to the top wall of the case main body at one end thereof and which has a presser plate provided at the other end thereof for pressing against coins accommodated is provided within the coin accommodating portion in such a manner as to expand vertically, so that coins are accommodated in such a manner as to be pressed against the bottom wall of the case main body via the presser plate.

4. A conjuring tool for performing a coin increasing trick as set forth in claim 3, wherein the accommodating opening closing lid is constructed so as to be brought into engagement with the case main body at the corn accommodating opening so that the closing lid does not come off the coin accommodating opening while being operated.

5. A conjuring tool for performing a coin increasing trick as set forth in claim 2, wherein the accommodating opening closing lid is constructed so as to be brought into engagement with the case main body at the corn accommodating opening so that the closing lid does not come off the coin accommodating opening while being operated.

6. A conjuring tool for performing a coin increasing trick as set forth in claim 1, wherein a spring which is fixedly attached to the top wall of the case main body at one end thereof and which has a presser plate provided at the other end thereof for pressing against coins accommodated is provided within the coin accommodating portion in such a manner as to expand vertically, so that coins are accommodated in such a manner as to be pressed against the bottom wall of the case main body via the presser plate.

7. A conjuring tool for performing a coin increasing trick as set forth in claim 6, wherein the accommodating opening closing lid is constructed so as to be brought into engagement with the case main body at the coin accommodating opening so that the closing lid does not come off the coin accommodating opening while being operated.

8. A conjuring tool for performing a coin increasing trick as set forth in claim 1, wherein the accommodating opening closing lid is constructed so as to be brought into engagement with the case main body at the coin accommodating opening so that the closing lid does not come off the coin accommodating opening while being operated.

* * * * *

UNITED STATES PATENT AND TRADEMARK OFFICE

CERTIFICATE OF CORRECTION

PATENT NO. : 6,935,961 B2
DATED : August 30, 2005
INVENTOR(S) : Shigeru Sugawara It is certified that error appears in the above-identified patent and that said Letters Patent is hereby corrected as shown below:

Column 6,
Lines 23 and 29, “corn” should read -- coin --.

Signed and Sealed this

Twenty-seventh Day of December, 2005

JON W. DUDAS
*Director of the United States Patent and Trademark Office*